United States Patent [19]

Craven

[11] 3,979,703

[45] Sept. 7, 1976

[54] WAVEGUIDE SWITCH

[75] Inventor: George Frederick Craven, Bushey Heath, England

[73] Assignee: International Standard Electric Corporation, New York, N.Y.

[22] Filed: Dec. 12, 1974

[21] Appl. No.: 531,944

[30] Foreign Application Priority Data

Feb. 7, 1974 United Kingdom ..... 5675/74

[52] U.S. Cl. ..... 333/98 S; 333/7 D

[51] Int. Cl.[2] ..... H01P 1/15

[58] Field of Search ..... 333/7 D, 98 S, 31 R, 333/31 A, 73 W, 81 B

[56] References Cited

UNITED STATES PATENTS

| | | | |
|---|---|---|---|
| 3,290,624 | 12/1966 | Hines | 333/31 R |
| 3,478,284 | 11/1969 | Blass et al. | 333/31 R X |
| 3,516,031 | 6/1970 | Commerford | 333/98 S |
| 3,701,055 | 10/1972 | Stiles | 333/7 D |
| 3,868,607 | 2/1975 | Hulderman | 333/98 S |

*Primary Examiner*—Paul L. Gensler

*Attorney, Agent, or Firm*—John T. O'Halloran; Peter C. Van Der Sluys; Vincent Ingrassia

[57] ABSTRACT

PIN diodes are ineffective as waveguide switches because the device and its connecting leads behave in total as an inductive obstacle.

There is described herein a method of converting the resultant obstacle into a broad band series resonant circuit which may be switched into two states. With the diode conducting, the obstacle appears as a short-circuit across the guide. With the diode nonconducting, the obstacle appears as an open circuit across the guide.

2 Claims, 21 Drawing Figures

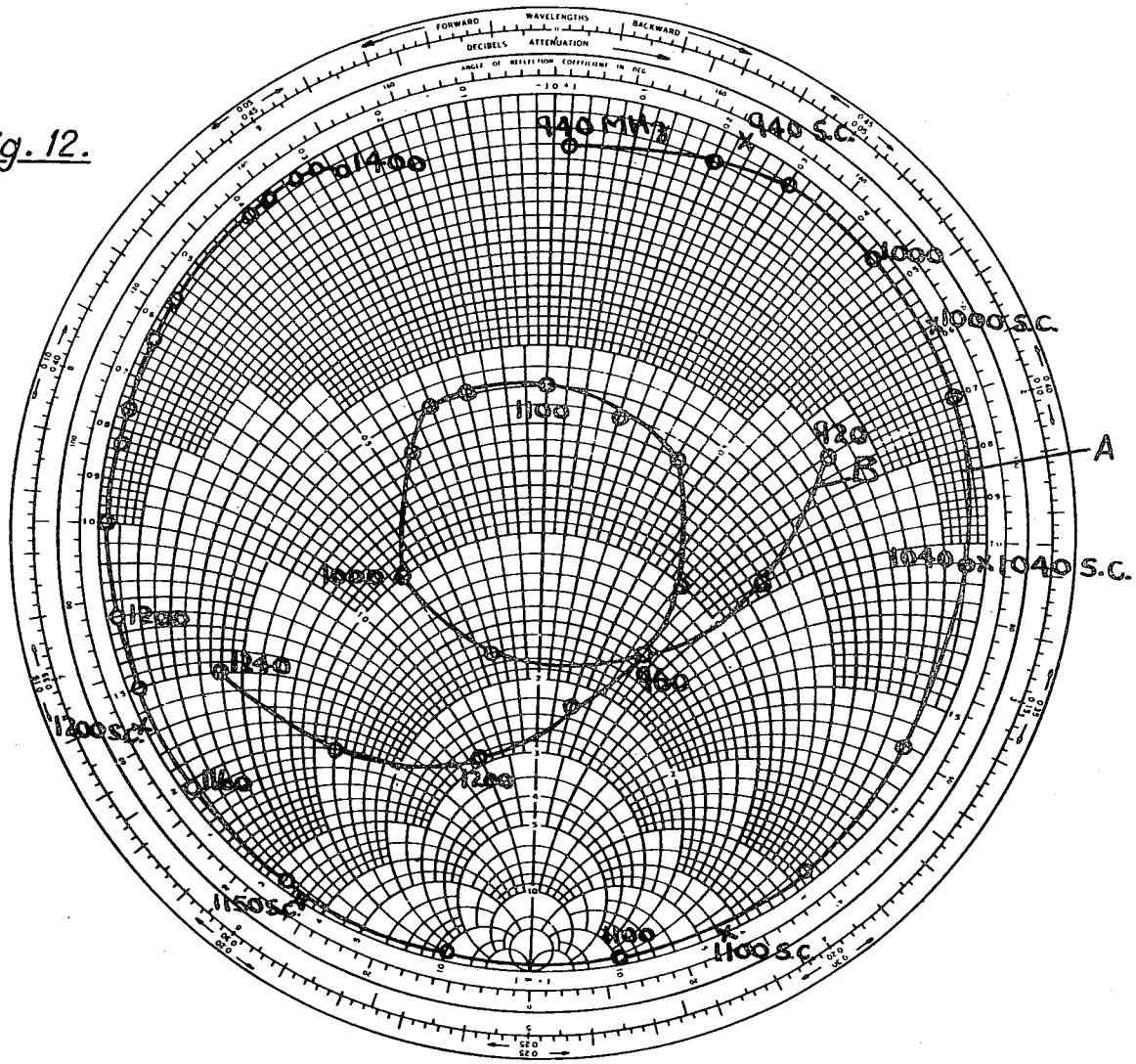
A
B
1040 S.C.
1100 S.C.
940 S.C.
1000
1100 S.C.
1150 S.C.
1200 S.C.
1250
1300
1350
1400
1450
1500
1550
1600
1650
1700
1750
1800
1850
1900
1950
2000
2050
2100
2150
2200
2250
2300
2350
2400
2450
2500
2550
2600
2650
2700
2750
2800
2850
2900
2950
3000
3050
3100
3150
3200

WAVEGUIDE SWITCH

BACKGROUND OF THE INVENTION

This invention relates to a waveguide switch. The advent of PIN diodes in the last decade or so has provided the important additional facility of rapid, low loss switching at microwave frequencies. Typically, the R.F. impedance of a diode can be switched over a range exceeding 10,000:1 (10,000$\phi$–0.5$\phi$) by changing from a reverse bias of one or two volts to a forward bias current of 0.1 amp. This characteristic has been exploited at microwaves in coaxial line and microstrip, in which the small cross-sectional dimensions of the center, or above group, conductor permit the terminal impedance properties of the device to be realized. In waveguide the problem is fundamentally much more difficult and necessitates a different approach to the problem.

SUMMARY OF THE INVENTION

It is an object of the invention to provide a waveguide switch which employs a PIN diode (or diodes) and which can function at high speeds.

According to the invention there is provided a waveguide switch comprising: a waveguide; and a first PIN diode across said waveguide having terminal connections within said waveguide, said terminal connections providing inductance and capacitance such that when the diode is ON, the combination of said diode and said terminal connections is series resonant within the frequency band of operation.

The above and other objects of the present invention will be better understood from the following detailed description taken in conjunction with the accompanying drawings, in which:

BRIEF DESCRIPTION OF THE DRAWINGS

FIG. 12 is an admittance plot of the switch of FIG. 9;

DESCRIPTION OF THE PREFERRED EMBODIMENTS

Figure 1:
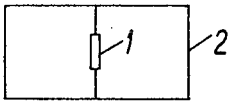
FIG. 1 shows a PIN diode across a waveguide.
Figure 2:
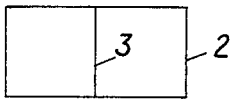
FIG. 2 represents a conducting PIN diode across a waveguide.

The basic problem may be illustrated by the following example. If a diode of the above type is placed in series with a transmission line ($Z_o$ = 100Ωsay), the impedance, under conduction conditions (0.5Ω), will introduce a very small power loss; under nonconduction conditions, the impedance (10,000Ω), will cause almost total reflection. However, if a PIN diode 1, FIG. 1, is placed across the full height of a waveguide 2 by connection between the broadwalls at the guide center (the shunt, rather than series, connection being appropriate in waveguides) it will, in the conducting state, constitute an obstacle which approximates very closely to an inductive post, 3, FIG. 2, the dimensions of which correspond to those of the connecting leads, and with an inductance $L_s$, FIG. 3. Thus, for a wire diameter of 0.5 mm and a guide width of 7.5 cm, one has a normalized reactance, $X/Z_o$, given by $$X/Z_o \approx 1$$

, where X is the reactance and $Z_o$ is the characteristic impedance, which would yield a V.S.W.R. (in shunt with a matched guide) of only about 3:1. This compares with a value of 200:1 which would be obtained in the previous transmission line example. The great disparity between these results arises from the well known fact, that simple impedance concepts are invalid when applied directly to calculating the impedance of an obstacle in a waveguide. The normalized impedance of the obstacle just considered is, primarily, determined by the ratio d/a, ($d$=diameter, $a$ = guide width) and is, therefore, basic to the dimensions involved. A larger waveguide, which would be necessary at lower frequencies, would result in a larger value of $X/Z_o$ with the same diode and, consequently, an even smaller v.s.w.r. Thus, the phenomenon is not a result of the high frequencies involved.

Figure 4:
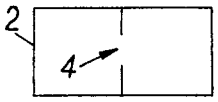
FIG. 4 represents a non-conducting PIN diode across a waveguide.

FIG. 4 represents a first order approximation to the obstacle 4 that results when the diode is in its non-conducting state. Although known as a capacitive post, this is only correct for small penetrations into the guide. For large penetrations the obstacle may attain series resonance and will then be, effectively, a short circuit across the guide. The equivalent circuit of such an obstacle is, therefore, the one shown in FIG. 5. Clearly, the impedance of this circuit may be quite low; it could be lower than the values achievable in the nominal short-circuit (diode conducting) state. Although the illustrates the basic problems of diode waveguide switches, it also provides an essential clue to a solution of the problem.

It should be emphasized that, although the present solution to the PIN diode switching problem is illustrated mainly with an application to a waveguide antenna switch, the solution is quite general to any waveguide switch.

Figure 6:
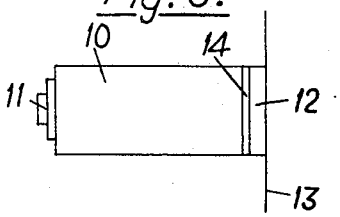
FIG. 6 shows an evanescent mode waveguide antenna radiating element containing an aperture switch.

The waveguide antenna generally considered in this description is that shown in FIG. 6; the basic radiating element comprises a single section length of evanescent mode waveguide 10 with a coaxial input 11 and a dielectric slice 12 (capacitive diaphragm) at the aperture in a ground plane 13. The diode 14 is located with the dielectric slice 12 at the aperture.

Figure 3:
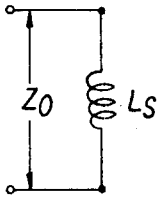
FIG. 3 is the equivalent circuit of FIG. 2.
Figure 5:
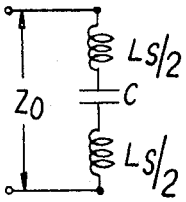
FIG. 5 is the equivalent circuit of FIG. 4.
Figure 7:
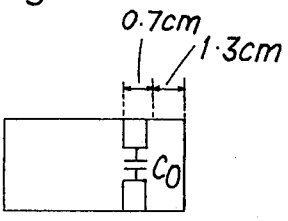
FIG. 7 shows a waveguide with an obstacle and added capacitance.
Figure 8:
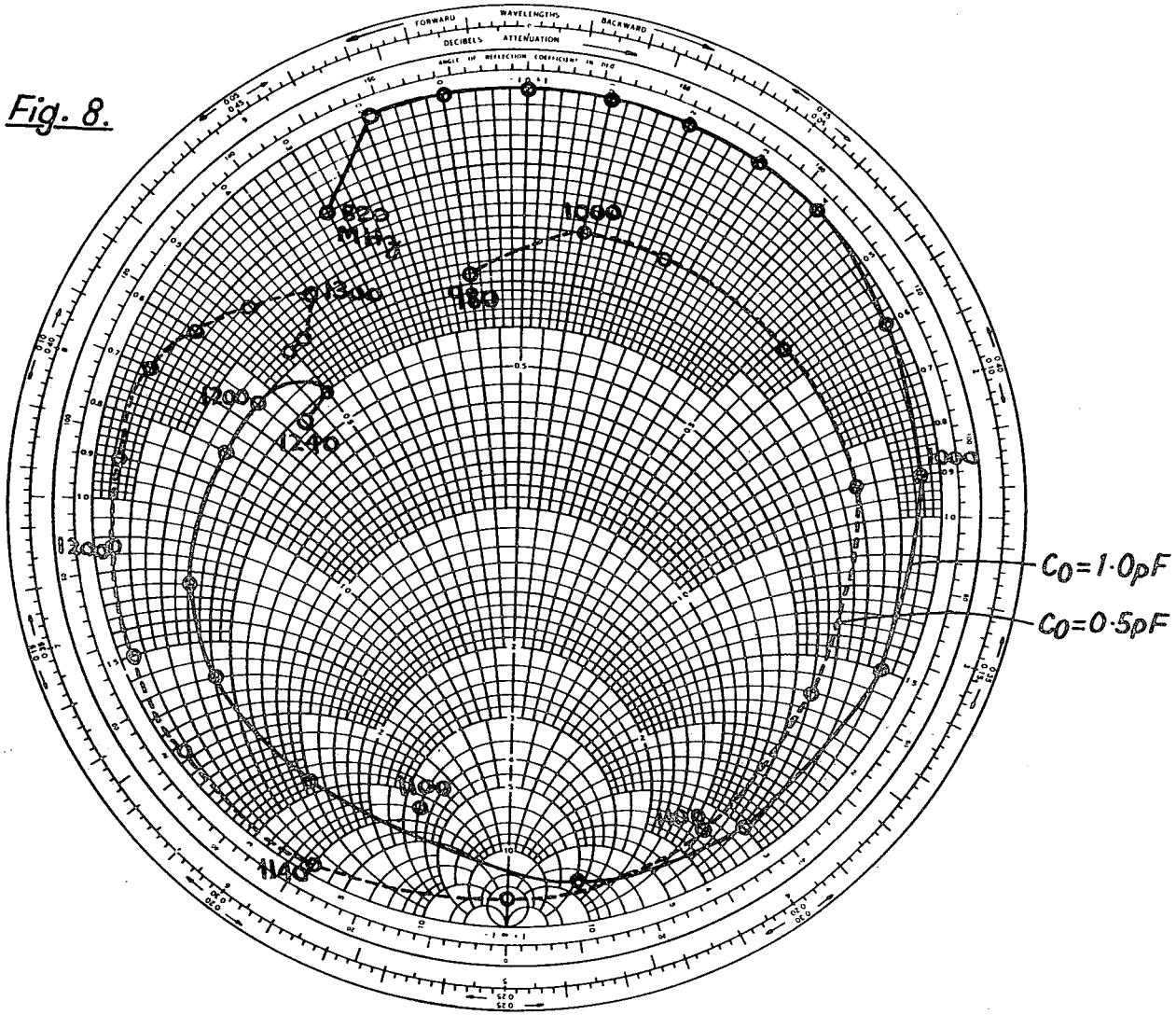
FIG. 8 is an admittance plot of a radiating element with the arrangement of FIG. 7 in the aperture.

As discussed above, the terminal properties of the diode (i.e., with the shortest physical lead length which is realizable) are virtually ideal, especially at lower microwave frequencies and, therefore, the basic principles of the switch may be described in terms of the simplified equivalent circuits of the diode in the guide (FIGS. 3 and 5). The common element in these two circuits is the inductance $L_s$. It has been shown quite rigorously (Lewin, L., "Advanced Theory of Waveguides", Iliffe, 1951) that, if the dimensions of the post are the same in each figure, the magnitude of $L_s$ in each lumped equivalent circuit is also the same. This is of value later when a more detailed understanding is considered. For the present, from FIG. 7 it will be clear that by choosing any desired value of C, $L_s$ C can be resonated at any frequency. This will, in general, necessitate a capacitor which is added to the natural capacitance which results from the field spreading across the gap in FIG. 4. The results which may be achieved with two different values of capacitor, Co, FIG. 7, of, respectively, 0.5 pF and 1.0 pF and with an obstacle dimensioned as shown, are illustrated in the input admittance curves (FIG. 8) of a normal radiating element with this additional circuit in the aperture. More detailed explanation of the measurement conditions is necessary for completeness and will be given later, but for the moment the large modulus of the reflection coefficient over a broad-band may be taken as indication of the broad-band character of the shortcircuit. This quality is a consequence of choosing a thick post 4 (actually, diaphragm), for the in-guide terminal connections for the PIN diode, which results in a small value of $L_s$. Thus, a relatively large value of C is required to establish resonance, and the complete circuit has the desirable property of a low L/C ratio. Thus, with the diode conducting, i.e., the switch ON, the obstacle formed by the diode and its in-guide connections, is made to present a high susceptance by tuning out the inductive element $L_s$ by making the obstacle as a whole (in its conducting state) series resonant.

Figure 9:
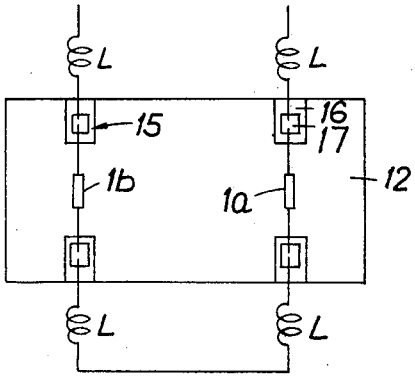
FIG. 9 shows a two-diode waveguide switch.

FIG. 9 shows a realization of this circuit in a practical waveguide aperture switch for a single section evanescent mode antenna element operating as the frequency band 0.962 – 1.213 $GH_3$. The switch incorporates two PIN diodes 1*a* and 1*b* each connected between lumped capacitors 15 each of 1.4pF. The use of two diodes is not of major significance, but has the advantage that symmetry in the aperture is preserved. The capacitors were made from P.T.F.E. fibre glass microstrip, the bottom plate 16, of each capacitor constituting a capacitive obstacle in addition to capacitive diaphragm 12. The PIN diodes 1*a* and 1*b* and (lumped) R.F. chokes L then connect to the top plates 17 of the respective capacitors.

Figure 10:
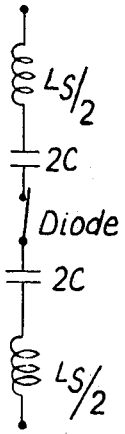
FIGS. 10 and 11 are the respective equivalent circuits of the switch of FIG. 9 when ON and when OFF.
Figure 11:
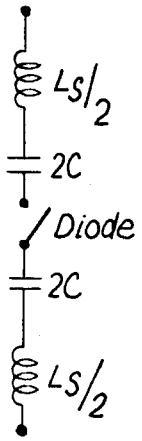

The equivalent circuits that result under conduction and nonconduction conditions, respectively, are those shown in FIGS. 10 and 11. The use of a short circuit to represent the diode in its conducting state is an obvious idealization; representing the nonconducting state by an open-circuit is equally so. However, a study of the measured results for these two states in FIG. 12 (plot A with the diodes ON and plot B with the diodes OFF) shows this is to be less of an approximation than might at first be thought, and is an indication of the excellent properties of PIN diodes in these applications. These admittance measurements were made at the coaxial input terminals of the antenna element. Although this is an appropriate plane at which to measure the input match, it causes a large apparent phase change in the admittance characteristic of the aperture switch. It is more realistic to locate the reference plane of the latter at the aperture. This necessitates an admittance plot with a short-circuit (metal plate or strips) located at the aperture. By comparing points on the admittance plot of the switch with corresponding plot points SC of the short-circuit, the true phase shift can be determined. In FIG. 12 the two points coincide at 1040 MHz which is, therefore, the resonant frequency of ($L_sC$) the aperture switch. The phase shift at other frequencies is small.

Figure 13:
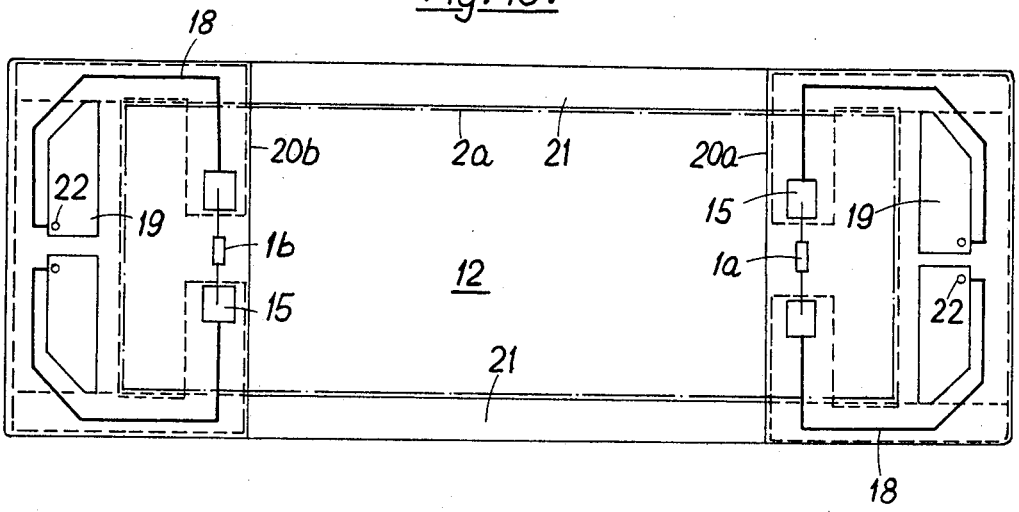
FIG. 13 shows a modified form of the two-diode waveguide switch.

In the switch shown in FIG. 13, each PIN diode, 1*a*, 1*b*, is connected between the top plates of the respective pair of capacitors 15, the respective bottom plates of the capacitors being an appropriate portion of the metal ground plane of the left-hand or right hand fibre glass board, 20*a*, 20*b*. Each board is attached to upper and lower metal strips 21 which also serve to assist retention of the capacitive diaphragm 12. The lumped circuit R.F. chokes L of FIG. 9 have been replaced by quarterwave chokes 18, and bypass capacitors 19 added on the power supply side of these chokes. There are bias terminals 22 on the top plates of the bypass capacitors 19. For manufacturing convenience, and also to make the assembly as rigid as possible, the fibre glass board has not been cut to the shape of the diaphragm, but the metal ground plane has been removed in the required places by the printing process. The edge of the ground plane follows the boundaries in FIG. 9 formed by the capacitive diaphragm (the walls being indicated by the long-alternately-short dashed line rectangle 2*a*) and waveguide walls and thus, merely reproduces this figure in a more manufacturable form. The admittance match shown in FIG. 12 may be broadbanded by more sophisticated methods of matching, but these are carried out elsewhere in the antenna element and are, therefore, irrelevant to the present invention.

Figure 14:
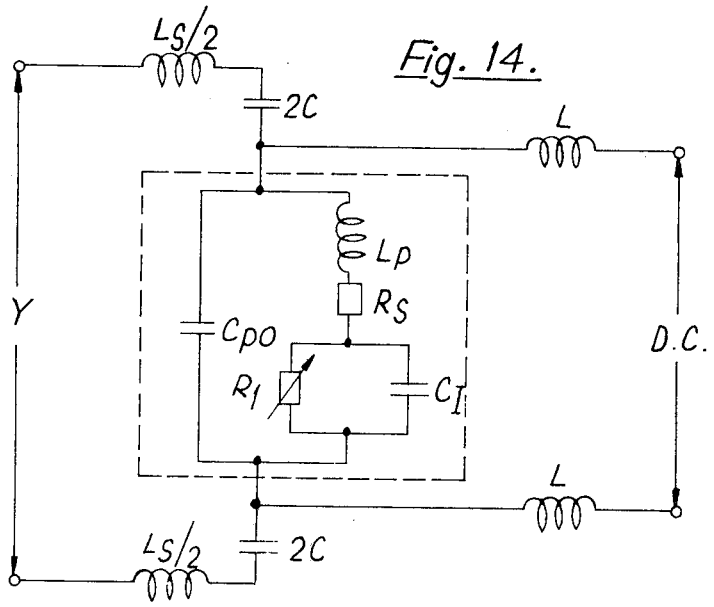
FIG. 14 is the full equivalent circuit of the diode switch.

Although the equivalent circuits so far considered are somewhat idealized, they are sufficiently accurate to explain the operation of the switch. However, a more accurate circuit can be obtained by introducing the manufacturer's equivalent circuit for the PIN diode package into the complete switch as shown within the dashed line rectangle in FIG. 14, where $L_p$ is the package inductance, $R_s$ the package series resistance, $C_{po}$ the package shunt capacitance, and $C_I$ and $R_I$ the operating capacitance and resistance respectively. This circuit can then be expressed in the two forms that are relevant for the conducting and non-conducting states, respectively. Assuming maximum bias current (0.1A) the total diode package impedance is less than one ohm i.e. $|X_{LS}| >> X_{LP}| + R_s + R_I|$ $X_{LS}$ is, of course, the normalized obstacle reactance which, as already discussed, is so large that it nullifies the effectiveness of a simple diode switch. This being the case the equivalent circuit under these conditions simplifies to that shown in FIG. 15.

Under reverse bias conditions $R_I >$ 10000Ω; $X_{CI}$ is also relatively large so that $X_{LP}$ and $R_s$ may be neglected. The equivalent circuit then reduces to that in FIG. 16.

Figure 15:
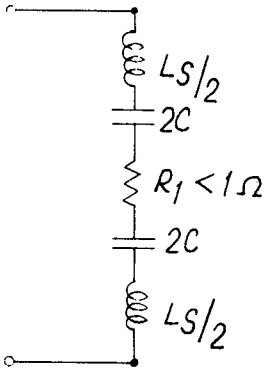
FIGS. 15 and 16 are the respective resulting equivalent circuits derived from FIG. 14 when the switch is ON and when it is OFF.
Figure 16:
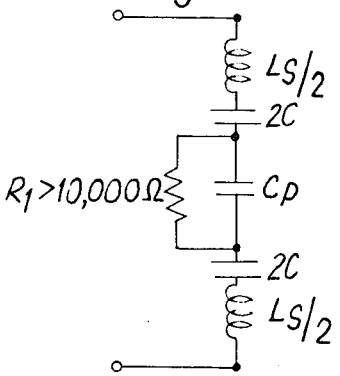

Comparing FIG. 15 and FIG. 16, representing the diode in its two states, both are series resonant circuits, one with the series damping and the other with shunt damping. The difference lies in the relative magnitudes of C and $C_p$; C has been chosen to resonate $L_s$ and so produce the desired short-circuit; $C_p$ is a parasitic capacitance which would, ideally, be zero. Thus, one of the reasons for making $L_s$ small (a wide diaphragm in preference to a thin post) becomes apparent: a large value of C is required to produce a given $L_sC$ product and the ratio of the series resonant frequencies in FIGS. 15 and 16, which determine the effectiveness of the switch, is thereby made large.

Figure 17:
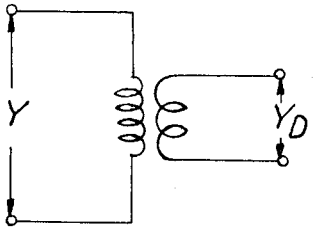
FIGS. 17 and 18 relate to a transformer function.
Figure 18:
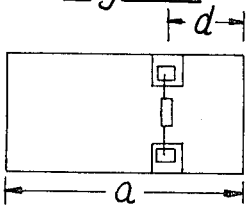

The transformer function Y $Y_2$ is shown in FIG. 17, is relates to these properties. The admittance of the circuit in FIG. 16 at the frequency of operation (diode switch non-conducting), represents a capacitive susceptance with a steeper slope than a pure capacitance (since it is infinite at a finite frequency). This adversely affects bandwidth. The choice of transformer ratio can be used to mitigate this effect at the expense of a decrease in the effectiveness of the short-circuit. The transformed admittance varies according to the expression $$Y = Y_D \sin^2 \frac{\pi d}{a}$$

where $Y_D$ = diode switch admittance in either state $d$ = distance from side wall $a$ = guidewidth the dimensions being shown in FIG. 18.

Thus, the 'short-circuit' is most effective if the diode is at the center of the guide, but this gives the narrowest bandwidth. In FIG. 9 a wide bandwidth was necessary and some small compromise in the effectiveness of the short circuit was acceptable.

Where two PIN diodes are used, bandwidth may be improved by staggering slightly the series resonant frequencies of the lefthand and right-hand circuits.

Figure 19:
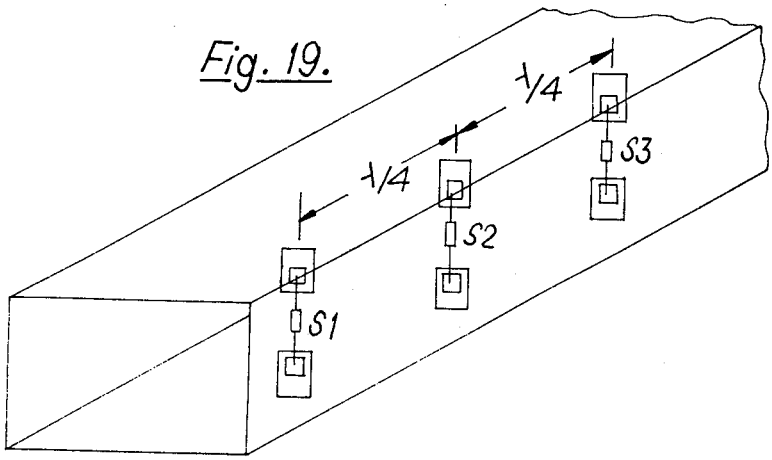
FIG. 19 shows a multi-section switch in propagating waveguide.
Figure 21:
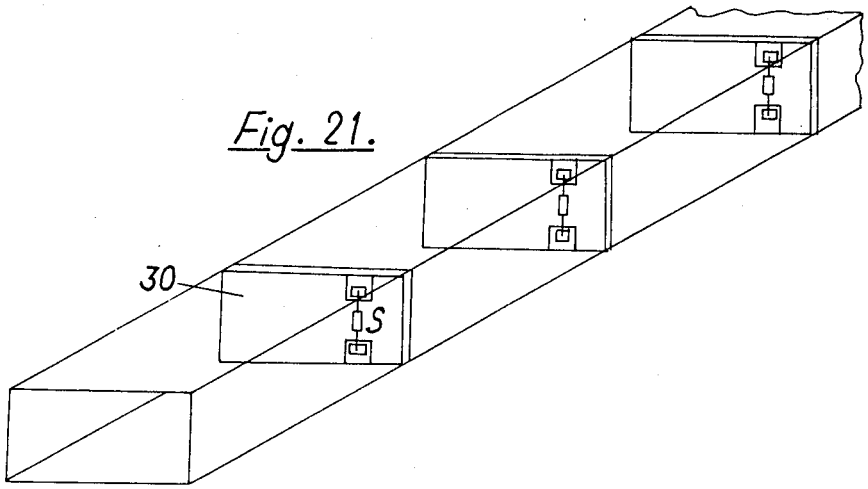
FIG. 21 shows a multi-section switch in evanescent waveguide.

Multi-section PIN diode switches are well known in the art and, similarly, the switch described above may be adapted to this use. FIGS. 19 and 21 show versions that are suited to conventional (propagating) and evanescent mode waveguide circuits, respectively.

Figure 20:
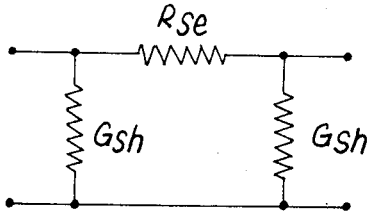
FIG. 20 is a ladder network representation of the multi-section switch.

In the propagating waveguide shown in FIG. 19 the individual sections $S_1$, $S_2$, $S_3$, are separated by a quarter-wavelength. By the well known principle of impedance inversion this network may then be represented by a ladder network FIG. 20, where $R_{se}$ is series resistance and $G_{sh}$ is shunt conductance. The attenuation of the complete switch is then nx dB where $n$ = number of sections $x$ = attenuation in dB per section.

With the switch ON $R_{se}$ and $G_{sh}$ are both low. With the switch OFF, $R_{se}$ and $G_{sh}$ are both high.

Similar reasoning applies to the three-section avanescent mode example (FIG. 21) in which the evanescent waveguide contains three dielectric capacitors 30 providing the requisite conjugate match condition. Each capacitor has an associated diode switch section S coplanar with it.

The basis of operation of evanescent mode waveguide as units is fully described in, for example, "Waveguide Bandpass Filters Using Evanescent Modes" G. F. Craven, Electronics Letters, Vol. 2, No. 7, July 1966, pp 25 – 26. It has been shown, Craven, G. F. and Mok, C. K. "The Design of Evanescent Mode Waveguide Bandpass Filters for a Prescribed Insertion Loss Characteristic" I.E.E.E. MTT-19 March 1971 P295 that coupled resonators of this type can be reduced to a ladder network and thus, the repesentation in FIG. 20 also holds for the example.

Although the general principles of the switch have been described assuming D.C. bias potentials of the appropriate magnitude and polarity, in most practical applications the bias will be switched rapidly from one state to the other. The switch has already been employed in systems in which the switching times are in the microsecond range, but this is nowhere near the limit of the technique. The ultimate limitation of the switch is the switch-off time of the diode, which relates to the frequency of operation. The diode will rectify at low frequencies in a normal way and therefore, if it is necessary to switch a comparatively low microwave frequency, the rectification frequency will also have to be relatively low. This will result in a correspondingly slower switching speed. In the present example (1 GHz) the required diode has a turn-off speed of 150 nanosec.; at 12 GHz the turn-off speed of an appropriate diode would be about 10 nanosec. Thus, in general the switch will be very fast.

While the principles of the invention have been described above in connection with specific apparatus, it is to be clearly understood that this description is made only by way of example and not as a limitation on the scope of the invention.

What is claimed is:

1. A waveguide switch comprising:

a waveguide; and a first PIN diode across the full height of said waveguide having terminal connections within said waveguide, said terminal connections providing relatively low inductance and relatively high capacitance such that when the diode is ON, the combination of said diode and said terminal connections in series resonant within the frequency band of operation, said first PIN diode and said terminal connections transversely displaced from the waveguide center line.

2. A waveguide switch according to claim 1 further including a second PIN diode having terminal connections, said first and second PIN diodes and their terminal connections coupled transversely in said waveguide on opposite sides of the waveguide center line.

* * * * *